US008421689B2

(12) United States Patent
Schlub et al.

(10) Patent No.: US 8,421,689 B2
(45) Date of Patent: Apr. 16, 2013

(54) ANTENNAS WITH TUNING STRUCTURE FOR HANDHELD DEVICES

(75) Inventors: Robert W. Schlub, Campbell, CA (US); Dean F. Darnell, Santa Clara, CA (US); Robert J. Hill, Salinas, CA (US); Teodor Dabov, Mountain View, CA (US); Hui Leng Lim, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/447,200

(22) Filed: Apr. 14, 2012

(65) Prior Publication Data

US 2012/0198689 A1 Aug. 9, 2012

Related U.S. Application Data

(62) Division of application No. 12/205,829, filed on Sep. 5, 2008, now Pat. No. 8,169,373.

(51) Int. Cl.
*H01Q 1/24* (2006.01)

(52) U.S. Cl.
USPC ..... 343/702; 343/700 MS

(58) Field of Classification Search ..... 343/700 MS, 343/702
See application file for complete search history.

(56) References Cited

U.S. PATENT DOCUMENTS

| | | | | |
|---|---|---|---|---|
| 4,876,552 | A | 10/1989 | Zakman | |
| 5,184,143 | A | 2/1993 | Marko | |
| 6,011,517 | A | 1/2000 | Skurski | |
| 6,054,955 | A | 4/2000 | Schlegel, Jr. et al. | |
| 6,124,831 | A | 9/2000 | Rutkowski et al. | |
| 6,348,894 | B1 | 2/2002 | Lahti | |
| 6,496,382 | B1 | 12/2002 | Ferguson et al. | |
| 6,515,630 | B2 * | 2/2003 | Honda | 343/702 |
| 6,861,990 | B2 | 3/2005 | Hung et al. | |
| 7,080,787 | B2 | 7/2006 | Wulff et al. | |
| 7,164,387 | B2 | 1/2007 | Sievenpiper | |
| 7,782,258 | B2 | 8/2010 | Lee et al. | |
| 7,884,724 | B2 | 2/2011 | Tuttle et al. | |
| 2001/0011964 | A1 * | 8/2001 | Sadler et al. | 343/824 |
| 2002/0019247 | A1 * | 2/2002 | Egorov | 455/557 |
| 2003/0124985 | A1 | 7/2003 | Shin et al. | |
| 2004/0178957 | A1 | 9/2004 | Chang et al. | |
| 2004/0223004 | A1 | 11/2004 | Lincke et al. | |
| 2006/0214850 | A1 * | 9/2006 | O'Riordan et al. | 343/700 MS |
| 2007/0135181 | A1 | 6/2007 | Ohki et al. | |

FOREIGN PATENT DOCUMENTS

| | | | |
|---|---|---|---|
| EP | 1 445 824 | A | 8/2004 |
| GB | 2 434 697 | A | 8/2007 |
| WO | 03/044891 | A | 5/2003 |

* cited by examiner

*Primary Examiner* — Tho G Phan
(74) *Attorney, Agent, or Firm* — Treyz Law Group; G. Victor Treyz; David C. Kellogg

(57) ABSTRACT

Handheld electronic devices are provided that contain wireless communications circuitry. The wireless communications circuitry may include antenna structures. To accommodate manufacturing variations, the antenna structures and handheld electronic devices may be characterized by performing measurements such as antenna performance measurements. Appropriate antenna adjustments may be made during manufacturing of a handheld electronic device based on the characterizing measurements. An antenna may be formed using an inverted-F design in which an antenna flex circuit is mounted to a dielectric antenna support structure. Cavities in the support may be selectively filled with dielectric material and dielectric patches may be added to the antenna flex circuit to adjust the dielectric loading of the antenna. The length of a ground return path in the antenna may be adjusted by appropriate positioning of an electrical connector within the ground return path.

19 Claims, 19 Drawing Sheets

ANTENNAS WITH TUNING STRUCTURE FOR HANDHELD DEVICES

This application is a division of patent application Ser. No. 12/205,829, filed Sep. 5, 2008 now U.S. Pat. No. 8,169,373, which is hereby incorporated by referenced herein in its entirety. This application claims the benefit of and claims priority to patent application Ser. No. 12/205,829, filed Sep. 5, 2008.

BACKGROUND

This invention relates generally to wireless communications circuitry, and more particularly, to antenna circuitry for electronic devices such as handheld electronic devices.

Handheld electronic devices are becoming increasingly popular. Examples of handheld devices include handheld computers, cellular telephones, media players, and hybrid devices that include the functionality of multiple devices of this type.

Due in part to their mobile nature, handheld electronic devices are often provided with wireless communications capabilities. Handheld electronic devices may use long-range wireless communications to communicate with wireless base stations. Handheld electronic devices may also use short-range wireless communications links. For example, handheld electronic devices may communicate using the WiFi® (IEEE 802.11) bands at 2.4 GHz and 5 GHz and the Bluetooth® band at 2.4 GHz. Communications are also possible in other bands.

To satisfy consumer demand for small form factor wireless devices, manufacturers are continually striving to reduce the size of components that are used in these devices. For example, manufacturers have made attempts to miniaturize the antennas used in handheld electronic devices.

A typical antenna may be fabricated by patterning a metal layer on a circuit board substrate or by patterning a sheet of thin metal using a foil stamping process. Antennas such as planar inverted-F antennas (PIFAs) and antennas based on L-shaped resonating elements can be fabricated in this way. Antennas may also be formed using flexible printed circuit substrates.

Although modern handheld electronic devices often need antennas with precisely defined radio-frequency responses, manufacturing variations and unexpected design changes can lead to situations in which an antenna is detuned somewhat from its optimal frequency response. These manufacturing variations may arise due to variations in the flexible printed circuit substrates that are used in forming the antennas. For example, antenna performance variations can arise when flex circuit substrates are produced by different manufacturers and are therefore not all identical.

It would therefore be desirable to be able to provide improved antennas and wireless handheld electronic devices.

SUMMARY

Handheld electronic devices and antennas for handheld electronic devices are provided. Antenna performance may be adjusted during manufacturing based on the results of characterizing measurements. The characterizing measurements may reveal, for example, that an antenna is not tuned properly due to manufacturing variations in the parts that are being used to assembly a handheld electronic device. To accommodate these manufacturing variations, compensating adjustments may be made to the antenna that correct the antenna's performance.

An antenna may be provided for the handheld electronic device using an antenna flex circuit. The antenna flex circuit may be wrapped around a dielectric antenna support structure in three dimensions by forming multiple right-angle bends in the antenna flex circuit. The antenna flex circuit may be used in forming an antenna such as an inverted-F antenna. The inverted-F antenna may have a main conductive arm and branch arms. One of the branch arms may be used in forming a ground return path for the inverted-F antenna.

The antenna may be formed in a handheld electronic device that has a conductive housing. The conductive housing may include a metal case and metal structural members such as a metal midplate member. These conductive housing portions may form part of the ground return path.

An electrical connector may be interposed in the ground return path. Based on the characterizing measurements that are made as part of the manufacturing process, an optimal location for the electrical conductor may be determined. During assembly, the electrical connector may be placed at this location, thereby establishing an appropriate length for the ground return path. By ensuring that the ground return path in the inverted-F antenna has a desired length, the performance of the inverted-F antenna may be tuned.

Antenna adjustments may also be made by selectively loading the antenna during the manufacturing process. With one suitable arrangement, the amount of dielectric loading on the antenna flex circuit is adjusted by selectively placing an appropriate dielectric layer on top of the antenna flex circuit. Dielectric loading adjustments may also be made by selectively filling cavities in the dielectric antenna support structure with a dielectric material. For example, one or more cavities may be selectively filled with a dielectric foam. The number of cavities that are filled in this way affects the amount of dielectric loading that is experienced by the antenna flex circuit and thereby adjusts the frequency resonances for the antenna. Dielectric loading adjustments such as these and path length adjustments such as adjustments to the length of the ground return path may be made to ensure that the frequency response of the antenna is properly tuned for optimal antenna performance.

The antenna flex circuit may be formed as an integral part of a larger flex circuit. The antenna flex circuit and the larger flex circuit of which it is a part may be used for mounting integrated circuits and for forming a path that connects to a main logic board.

Further features of the invention, its nature and various advantages will be more apparent from the accompanying drawings and the following detailed description of the preferred embodiments.

DETAILED DESCRIPTION

The present invention relates generally to wireless communications, and more particularly, to wireless electronic devices and antennas for wireless electronic devices.

The wireless electronic devices may be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, which is sometimes described herein as an example, the portable electronic devices are handheld electronic devices.

The handheld devices may be, for example, cellular telephones, media players with wireless communications capabilities, handheld computers (also sometimes called personal digital assistants), remote controllers, global positioning system (GPS) devices, and handheld gaming devices. The handheld devices may also be hybrid devices that combine the functionality of multiple conventional devices. Examples of hybrid handheld devices include a cellular telephone that includes media player functionality, a gaming device that includes a wireless communications capability, a cellular telephone that includes game and email functions, and a handheld device that receives email, supports mobile telephone calls, has music player functionality and supports web browsing. These are merely illustrative examples.

Figure 1:
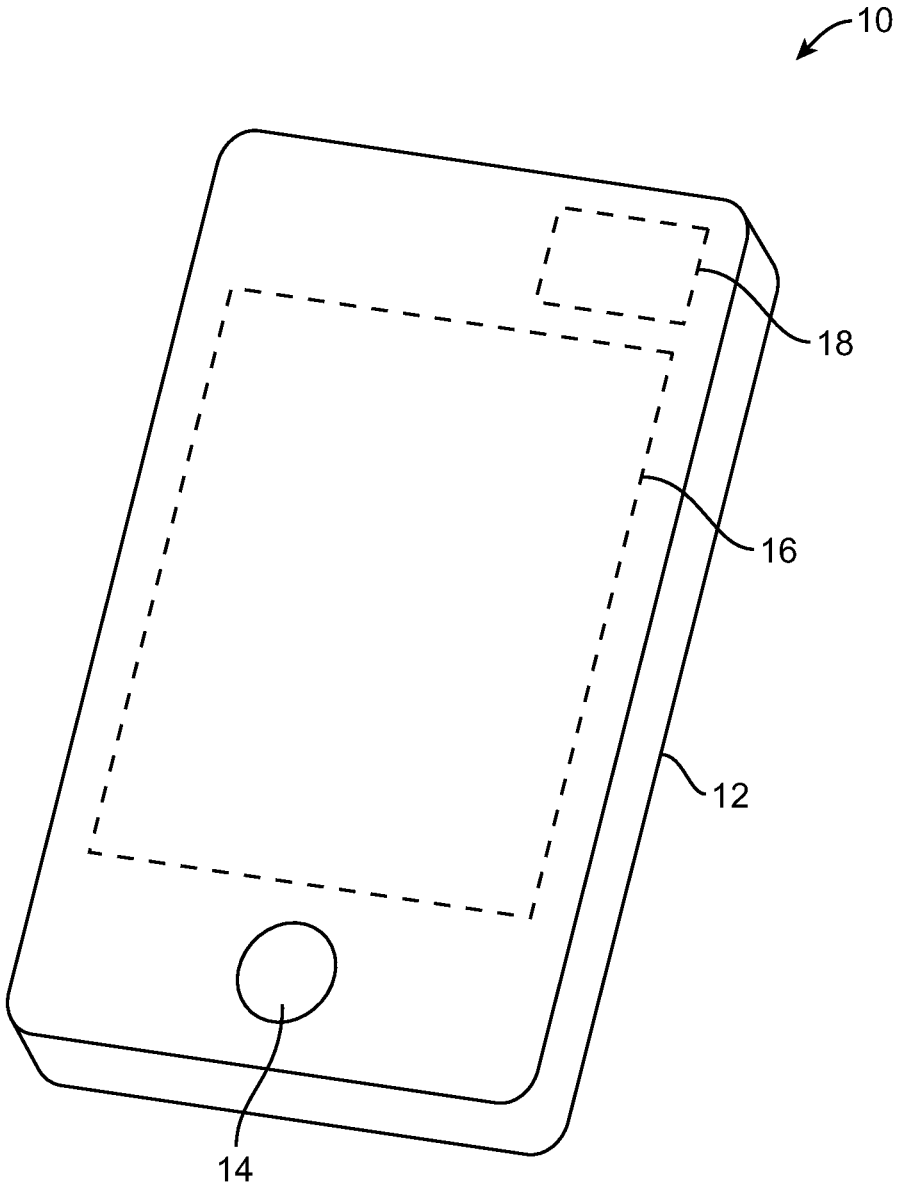
FIG. 1 is a front perspective view of an illustrative handheld electronic device with an antenna in accordance with an embodiment of the present invention.

An illustrative handheld electronic device in accordance with an embodiment of the present invention is shown in FIG. 1. As shown in FIG. 1, device 10 may have a housing 12. Device 10 may include user input interface devices such as button 14. Other input-output devices that may be provided in device 10 include display 16, additional buttons (e.g., for placing device 10 in standby mode), data ports, audio jacks, speakers, etc. Display 16 may, for example, be a touch screen display.

Device 10 may include one or more antennas for handling wireless communications. Embodiments of device 10 that contain a single antenna are sometimes described herein as an example. The antenna in device 10 may be located, for example, where indicated by dashed lines 18. Antenna 18 may be used to cover WiFi® (IEEE 802.11) bands at 2.4 GHz and/or 5 GHz and/or the Bluetooth® communications band at 2.4 GHz. These are merely illustrative examples. Antenna 18 may be configured to handle any suitable communications band or bands of interest.

Figure 2:
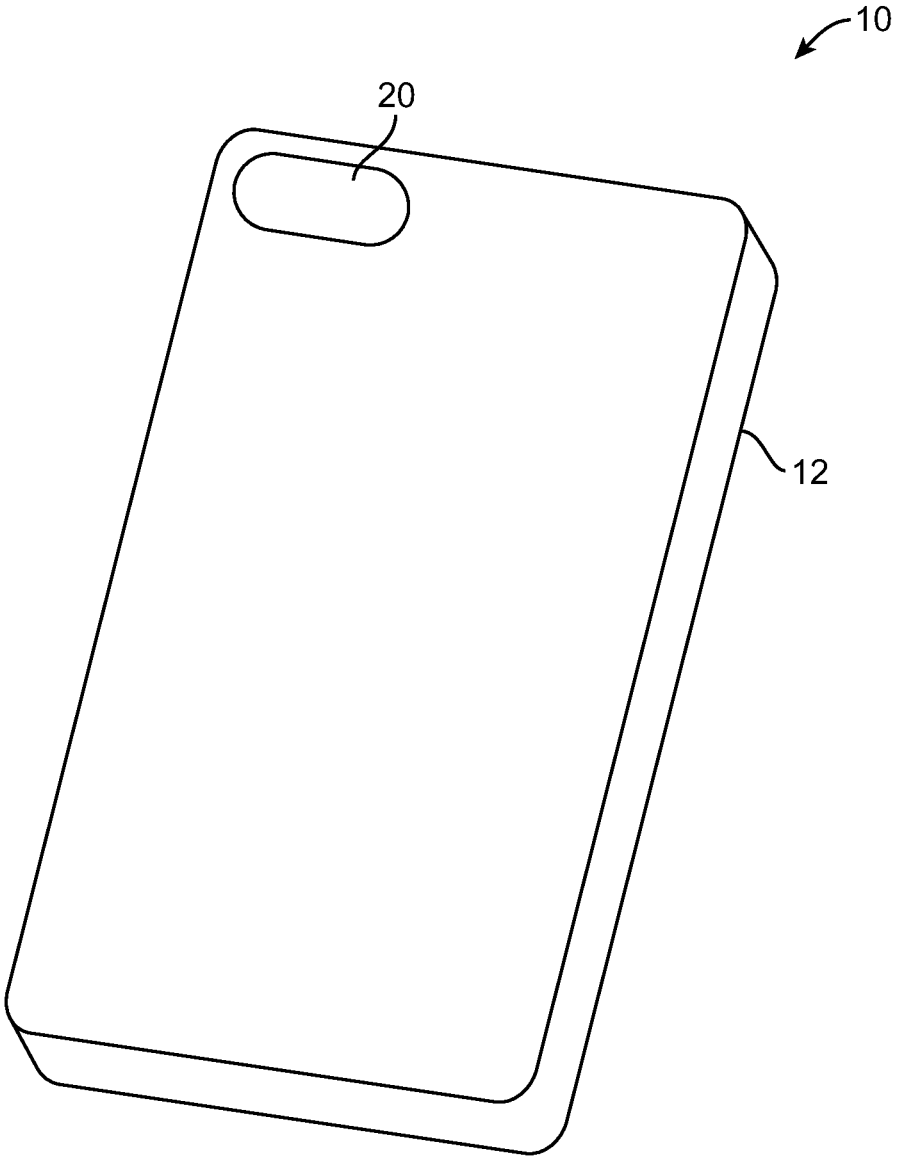
FIG. 2 is a rear perspective view of an illustrative handheld electronic device with an antenna in accordance with an embodiment of the present invention.

Housing 12, which is sometimes referred to as a case, may be formed of any suitable materials such as plastic, glass, ceramics, metal, other conductive or insulating materials, or a combination of these materials. As an example, housing 12 or portions of housing 12 may be formed from conductive materials such as stainless steel, or aluminum. In configurations in which housing 12 is mainly formed from a conductive material such as metal, one or more portions of housing 12 may be formed from a dielectric or other low-conductivity material to form an antenna "window." This type of arrangement is shown in the rear view of device 10 of FIG. 2. As shown in FIG. 2, housing 12 may have a dielectric antenna window such as window 20, so that antenna 18 is not blocked by housing 12. During operation, radio-frequency signals may be conveyed between antenna 18 and external equipment through window 20. Window 20 may be formed of plastic or other suitable dielectrics.

An example of a plastic that may be used in forming window 20 and other dielectric structures in device 10 is PC-ABS (a blend of polycarbonate and acrylonitrile butadiene styrene). This type of plastic may be used, for example, to form a support for a flex circuit antenna structure.

Additional dielectrics that may be used in device 10 include materials such as glass, polyimide (e.g., in the form of flexible printed circuit board substrates called flex circuits), epoxy (e.g., in rigid circuit boards), flexible plastic films covered with pressure sensitive adhesive (i.e., double-sided tape), Kapton® (a brand of polyimide available from Dupont Electronics), dielectric foam, gel, dielectrics filled with hollow or solid dielectric microspheres, etc.

Due to manufacturing variations, parts of device 10 may be manufactured with shapes and sizes that do not exactly match ideal specifications. In some situations, sufficient tolerance may be built into the design for device 10 to accommodate these manufacturing variations. As an example, if it is intended that two plastic parts fit together, these parts may be manufactured so that there is sufficient clearance between the parts to accommodate variations in size due to manufacturing variations.

Other types of manufacturing variations may be more difficult to accommodate. For example, changes in the shape and size of antenna parts in device 10 may affect the performance of antenna 18. If care is not taken, antenna 18 will not be tuned properly and will therefore not be able to satisfactorily cover a communications band of interest.

Antenna 18 may be designed with sufficient tolerance to accommodate manufacturing variations. Adjustable features may also be incorporated into antenna 18. These features may allow the performance of the antenna to be tuned during the manufacturing process. For example, the adjustable features of antenna 18 may allow the frequency of the communications band (or bands) that are covered by antenna 18 to be adjusted.

Figure 3:
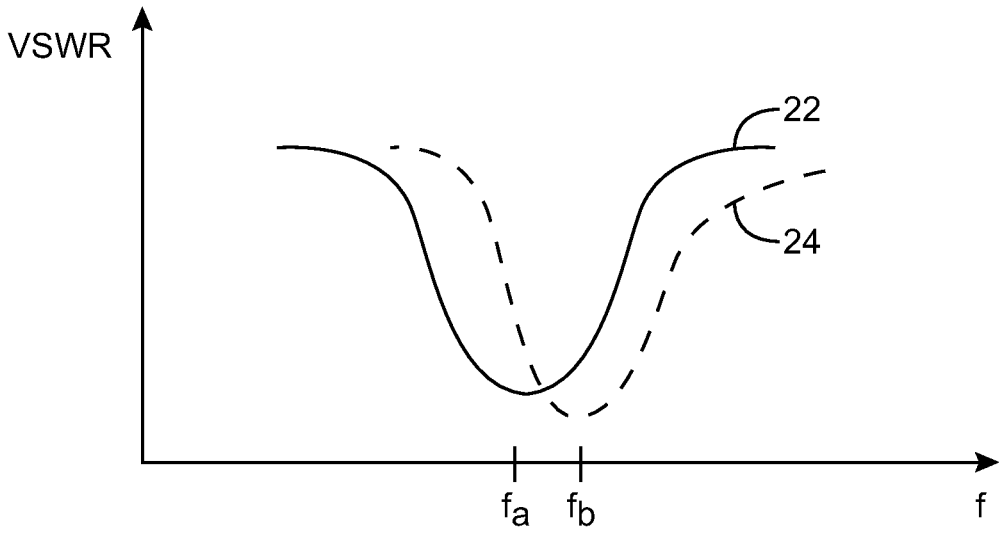
FIG. 3 is a graph showing how antennas may be tuned in accordance with an embodiment of the present invention.

An illustrative situation is shown in FIG. 3. As shown in FIG. 3, antenna 18 may nominally have a frequency response peak at frequency $f_b$. This is the desired operating frequency for the antenna and is characterized by curve 24 in FIG. 3. Due to manufacturing variations (e.g., variations during the manufacturing process used to create a flex circuit for antenna 18), the actual performance of antenna 18 may initially be detuned. For example, when first measured as part of a test characterization operation, antenna 18 may be characterized by a frequency response of the type shown by curve 22. As shown in FIG. 3, curve 22 has a frequency response peak of $f_a$, not $f_b$ as desired.

If frequencies $f_a$ and $f_b$ are sufficiently close, antenna 18 will operate satisfactorily. However, if frequencies $f_a$ and $f_b$ are too dissimilar, it may be advantageous to adjust antenna 18 as part of the manufacturing process. If appropriate adjustments are made, the frequency peak of antenna 18 will be tuned from $f_a$ to $f_b$, thereby ensuring that antenna 18 will operate properly during normal use by a customer.

Antenna 18 may be formed from any suitable antenna structures. For example, antenna 18 may be implemented using a planar inverted-F (PIFA) structure, an L-shaped antenna resonating element, a slot antenna structure, etc. With one suitable arrangement, which is described herein as an example, antenna 18 may be formed using an inverted-F design, as shown in FIG. 4.

Figure 4:
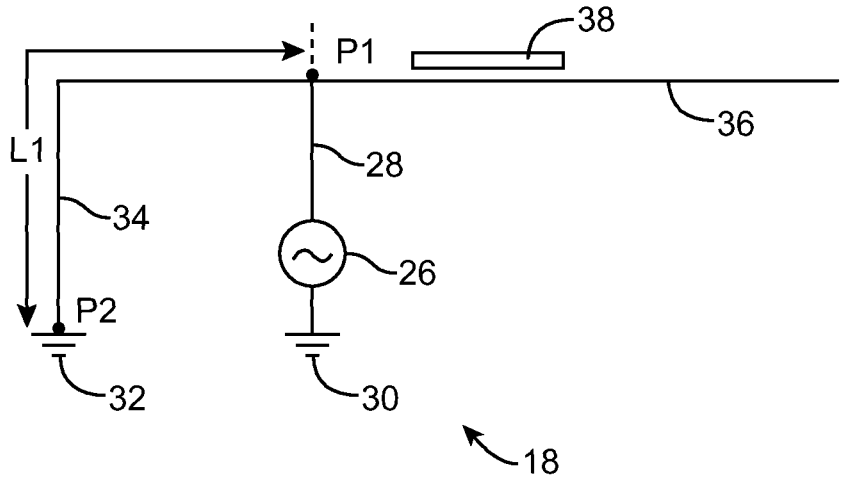
FIG. 4 is a schematic diagram of an adjustable antenna for a handheld device that is based on an inverted-F antenna design in accordance with an embodiment of the present invention.

As shown in the schematic diagram of FIG. 4, inverted-F antenna 18 may have main antenna resonating element 36. The F-shaped structure of antenna 18 is formed by two shorter arms—arm 34 and arm 28. Arms 34 and 28 form conductive branch paths for antenna 18. Arm 34 may extend between ground 32 and main arm 36. Similarly, arm 28 may extend between ground 30 and antenna resonating element arm 36. As indicated by signal source 26 in FIG. 4, antenna 18 may be fed between ground 30 and arm 28. Ground 30 and ground 32 may be shorted together and may therefore be considered to form part of the same ground plane.

The frequency response of antenna 18 may be adjusted by altering the shapes and sizes of the structure of FIG. 1. For example, adjustments to the length L1 of the ground return path in antenna 4 (i.e., the conductive path between points P1 and P2 in FIG. 4) may be used to tune the frequency response of antenna 18. Tuning may also be accomplished by altering the amount of dielectric loading on the elements of antenna 18. As an example, dielectric 38 may be added or taken away in the vicinity of the conductive traces of antenna 18, thereby altering the effective length of the traces and tuning the frequency response of antenna 18.

Dielectric loading may be implemented using any suitable scheme. For example, one or more lengths of polyimide (e.g., Kapton® polyimide from DuPont Electronics) may be added to or removed from antenna 18. As another example, dielectric such as non-conductive foam may be inserted into a cavity adjacent to the conductive lines in antenna 18. When more dielectric foam is added, dielectric loading is increased, thereby effectively altering the path length of one or more of the portions of antenna 18 (e.g., arm 36 and/or arms such as arms 34 and 28).

Once a manufacturer has determined that antenna 18 is working properly with a given amount of dielectric loading and/or a given length L1 for the ground return path in antenna 18, it is generally not necessary to make additional adjustments on a device-by-device basis. Rather, all devices 10 that are formed from identical parts can be manufactured using the same amount of adjustable dielectric loading and using an adjustable ground return path of the same length. Nevertheless, should testing reveal that there are significant device-to-device variations, a manufacturer may, if desired, make more frequent adjustments (e.g., on a per-device or per-batch basis). In a typical scenario, tuning is used to accommodate variations in the sizes and shapes of subsystems that are acquired from various vendors whose manufacturing processes may or may not be directly under the control of the device manufacturer.

Figure 5:
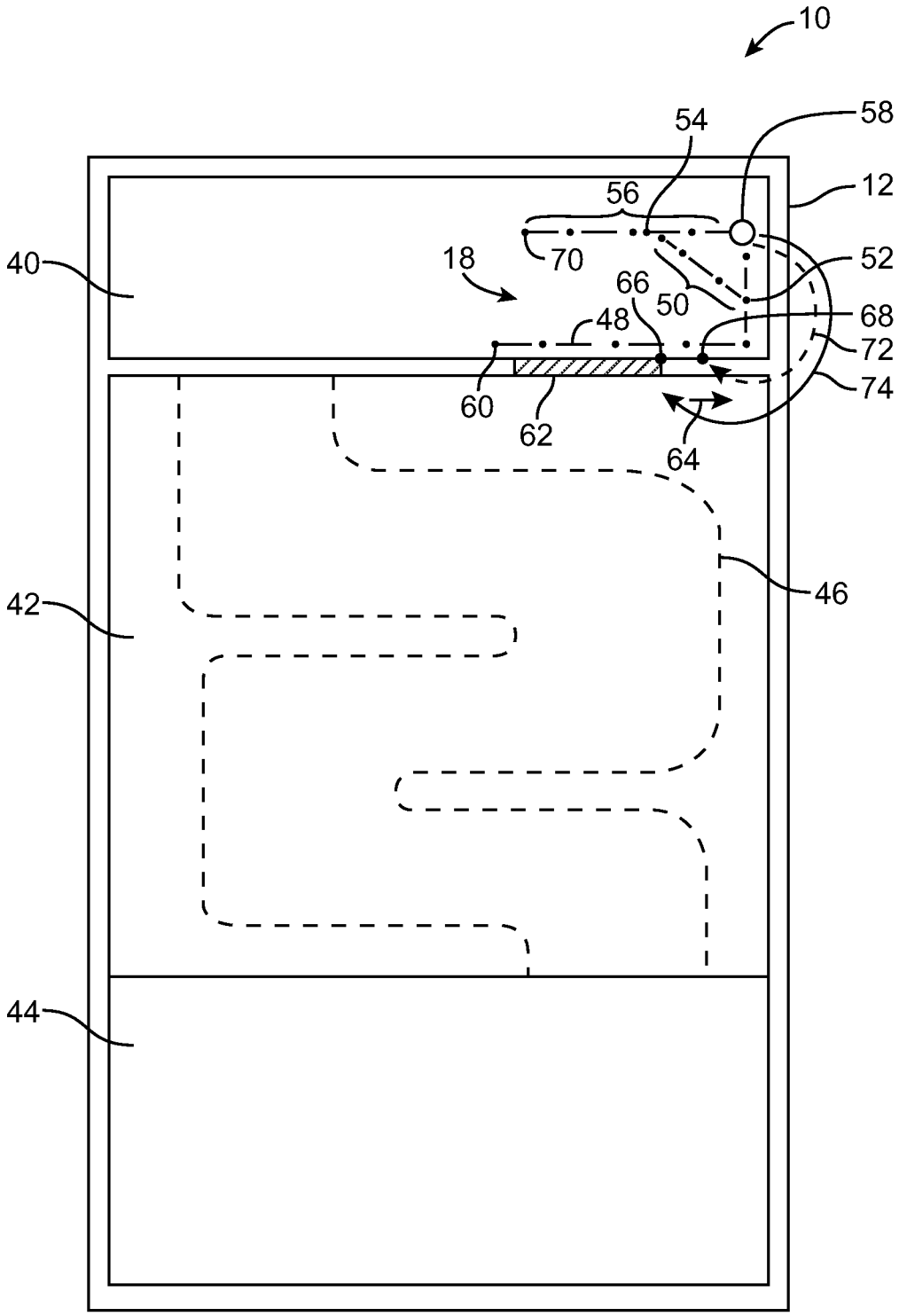
FIG. 5 is a top view of an illustrative handheld device showing how an antenna may be tuned by adjusting the position of a conductive elastic structure such as a conductive elastomer in accordance with an embodiment of the present invention.

FIG. 5 shows a top view of an illustrative electronic device 10 showing how antenna 18 may be tuned by adjusting the position of a conductive component that is interposed in the ground return path of antenna 18. As shown in FIG. 5, device 10 may have components such as main logic board 44, midplate assembly 42 (which may be attached to housing 12 or may be considered to form part of conductive housing 12 for device 10), and radio-frequency antenna assembly 40. Antenna assembly 40 may have a main structural member formed from plastic. This structure, which may be formed from one or more subparts, is sometimes referred to herein as an antenna support.

Conductive paths that make up antenna 18 may be formed from any suitable conductive structures in device 10. With one suitable arrangement, conductive paths for antenna 18 are partly formed from conductive traces on a flexible printed circuit substrate. Flexible printed circuit substrates, which are sometimes referred to as flex circuits, may be formed from flexible dielectrics such as polyimide. Conductive flex circuit traces may be formed, for example, from gold, copper, or other suitable materials. As with rigid printed circuit boards, flex circuits may contain multiple layers, so that conductive traces may cross one another without becoming shorted to each other. Transmission line structures such as microstrip transmission lines structures may be formed in flex circuits by running positive and ground conductors in parallel (e.g., on the same layer of the flex circuit, on different layers of the flex circuit, or both on the same and different layers).

If desired, the same flex circuit that is used in forming part of antenna 18 may be used to interconnect antenna assembly 40 with main logic board 44. This portion of the flex circuit may have a meandering path to provide flexibility to the flex circuit structure during assembly. Dashed lines 46 show an illustrative meandering path that the flex circuit may take when connecting antenna assembly 40 and main logic board 44.

In the example of FIG. 5, some of the conductive portions of antenna 18 are formed by non-flex structures such as portions of conductive housing 12 and conductive elastic connector 62.

The portion of antenna 18 that is shown in the schematic representation of FIG. 5 receives outgoing radio-frequency signals at point 60 (e.g., from an output associated with an output amplifier on assembly 40). When receiving over-the air signals, signals are provided from antenna 18 to circuitry on board 44 via point 60.

Between point 60 and point 52 along path 48, the antenna traces in the flex circuit structure that makes up the antenna form a transmission line (e.g., a microstrip transmission line). At point 52, the positive and ground conductive paths of the antenna diverge. The ground path continues by itself to point 58. At point 58, a screw and other conductive structures may be used to ground antenna 18 to case 12. Between points 52 and 54, along segment 50 of antenna 18, the positive conductive path is unaccompanied by the ground path. There is also no accompanying ground path along segment 56 between point 70 and point 58. Segment 56 of antenna 18 in the diagram of FIG. 5 corresponds to arm 36 in the schematic of FIG. 4. Although illustrated as a straight line, this portion of antenna 18 may, if desired, contain one or more bends to make antenna 18 more compact and to ensure that the distal end of segment 56 is not immediately adjacent to conductive housing portions in device 10.

The ground return path of antenna 18 includes point 58, the conductive case 12, the upper right corner of midplate 42, and conductive foam 62. The ground return path terminates on a ground trace in portion 48 of antenna 18. With this arrangement, the performance of antenna 18 can be tuned, because the position of conductive foam 62 along lateral dimension 64 controls the length L1 of the ground return path. If conductive foam 62 is positioned in the location shown in FIG. 5, the ground return path terminates at point 66, as shown by path 74. If conductive foam 62 is moved slightly in direction 64, the ground return path for antenna 18 will terminate at point 68, as shown by path 72. Because path 72 and path 74 have different lengths, the position of conductive foam 62 can be used as an adjustable parameter that controls the length L1 of the ground return path in inverted-F antenna 18.

The use of conductive foam 62 to complete the ground return path in the FIG. 5 example is merely illustrative. Any suitable adjustable conductive structures may be used in adjusting the ground return path length. For example, the length of the ground return path may be adjusted by making selective connections using springs, spring-loaded pins, or other elastic connectors. Path length adjustments may also be made by making selective solder connections, by adjusting the position of a screw or other mechanical fastener, by plugging a connector into an appropriate socket, by inserting a bridging wire at a particular location, or by making any other suitable adjustable electrical connection. The use of an elastic connection such as elastomeric foam is merely illustrative.

If desired, adjustable dielectric loading schemes may be used to adjust the performance of antenna 18. Dielectric loading changes the effective length of antenna elements. The resonating properties of antennas can be strongly affected by the lengths of the resonating elements in the antennas. If, for example, an element has a length that matches a fraction of a wavelength (e.g., a half of a wavelength or a quarter of a wavelength), the antenna may exhibit a resonant peak. The "wavelength" in consideration when determining whether or not an antenna has a resonance is the effective wavelength of the radio-frequency signal being transmitted or received taking into account the dielectric constant of adjacent dielectrics. By adjusting the amount of dielectric loading on portions of antenna 18, the effective wavelength associated with a resonant peak may be adjusted, thereby tuning the antenna, as described in connection with FIG. 3.

Figure 6:
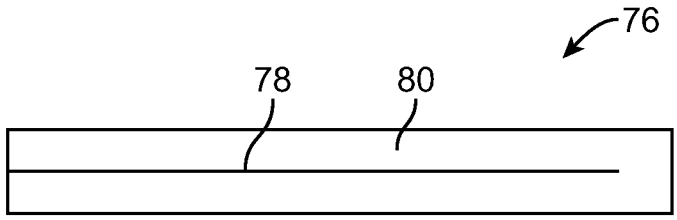
FIG. 6 is a cross-sectional side view of an illustrative antenna formed from a flex circuit in accordance with an embodiment of the present invention.
Figure 7:
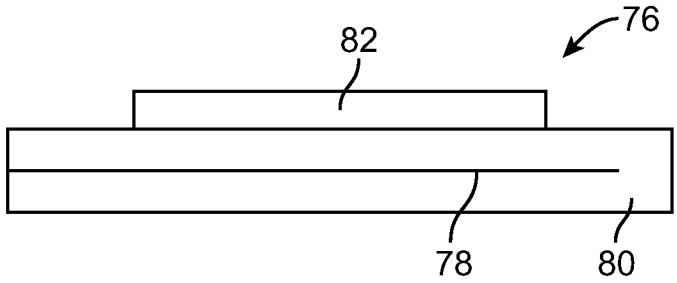
FIG. 7 is a cross-sectional side view of an illustrative antenna of the type shown in FIG. 6 to which dielectric loading has been added to adjust the antenna's performance in accordance with an embodiment of the present invention.

An example is illustrated in FIGS. 6 and 7. In FIG. 6, an illustrative cross-sectional diagram of a portion of a flex circuit antenna is shown. Antenna portion 76 has a flex circuit dielectric 80 (e.g., polyimide) containing a conductive antenna trace 78. Trace 78 may be, for example, a portion of an inverted-F antenna such as portion 56 of antenna 18 in FIG. 5. In the FIG. 6 example, air surrounds flex circuit 80, so there is minimal dielectric loading on antenna portion 56. In the FIG. 7 example, dielectric loading structure 82 has been placed adjacent to a length of antenna portion 76. Dielectric loading structure 82 may be, for example, a patch of polyimide film. Dielectric loading structure 82 may be attached to antenna portion 76 by adhesive or any other suitable arrangement. The presence of dielectric loading structure 82 changes the effective wavelength of the radio-frequency signals in antenna portion 76 and thereby adjusts the frequency at which antenna 18 exhibits its resonant peak. Antenna 18 may be adjusted in this way by attaching and removing dielectric loading structures of various sizes from the surface of the antenna flex circuit.

Figure 8:
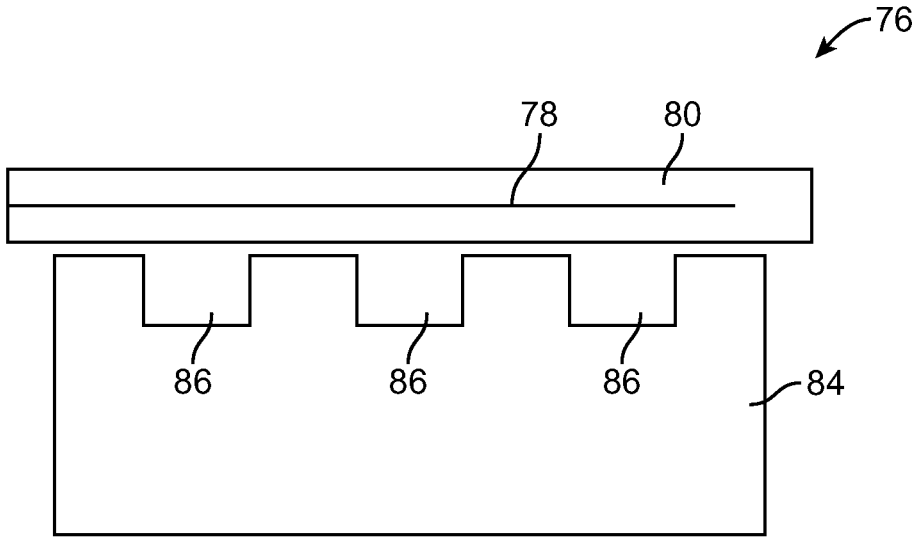
FIG. 8 is a cross-sectional side view of an illustrative antenna formed from a flex circuit mounted on an antenna support with empty cavities in accordance with an embodiment of the present invention.
Figure 9:
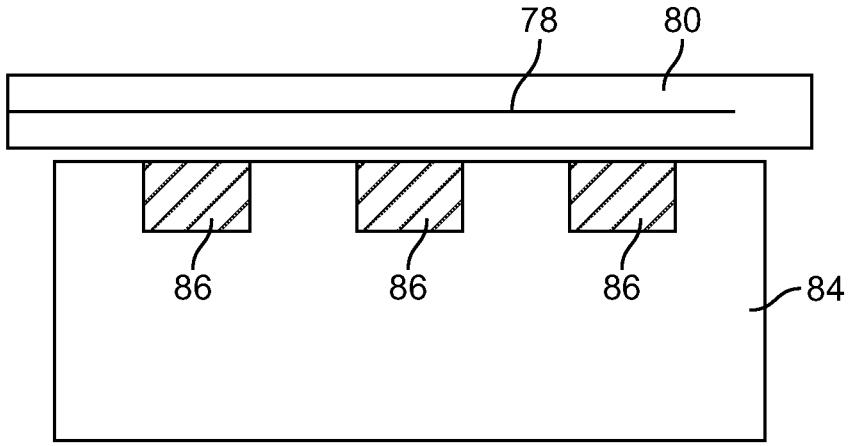
FIG. 9 is a cross-sectional side view of an illustrative antenna formed from a flex circuit mounted on an antenna support with cavities that have been filled with a non-air dielectric to tune the antenna in accordance with an embodiment of the present invention.

Another dielectric loading scheme that may be used involves selectively filling cavities in the antenna support structure for antenna 18. This type of arrangement is illustrated in connection with FIGS. 8 and 9, which show cross-sections of an antenna having an antenna flex circuit portion 76 that is mounted on antenna support 84. Antenna support 84 may have cavities 86 adjacent to flex circuit portion 76. In the illustrative arrangement shown in FIG. 8, cavities 86 are empty prism-shaped regions (i.e., prism-shaped polyhedrons filled with air). In the illustrative arrangement shown in FIG. 9, cavities 86 have been filled with a dielectric such as foam. If desired, other dielectrics may be used to fill cavities 86 (e.g., solid plastic plugs, epoxy, gels, microsphere-filled substances, etc.). Any suitable number of cavities 86 may be provided on a given antenna support 84 and any suitable number of cavities may be filled (e.g., none, one, two, three, more than three, etc.). When none of the cavities are filled, dielectric loading will be minimized. When all of the cavities are filled, dielectric loading will be maximized. Intermediate antenna tuning configurations may be obtained by selectively filling a desired number of the cavities with dielectric (i.e., dielectric materials other than air).

Cavities 86 may, in general, have any suitable shape. For example, cavities 86 may have rectangular surface cross-sections and may be cubic in shape (in three dimensions). Such cubic cavities may have sides of equal length or may have sides of different lengths (e.g., to form rectangular cross-sections with dissimilar sides). The shape of the surface opening of cavities 86 may also have other any other suitable shape such as a triangular shape, a trapezoidal shape, a circular shape, an oval shape, the shape of a polygon with four or more than four sides, a shape with both straight and curved sides, a shape with irregular curved sides, etc. These surface shapes may be form part of three-dimensional cavities of various shapes such as conical shapes, hemispherical shapes, prisms and other polyhedrons, pyramids, cylinders, cones, combinations of these forms, etc. The use of polyhedral shapes is sometimes described herein as an example. Each cavity 86 may have substantially the same size or a nonunitary weighting scheme may be used for the sizes of cavities 86.

Illustrative structures that may be used to implement antenna 18 in device 10 in accordance with embodiments of the present invention are shown in FIGS. 10-19.

Figure 10:
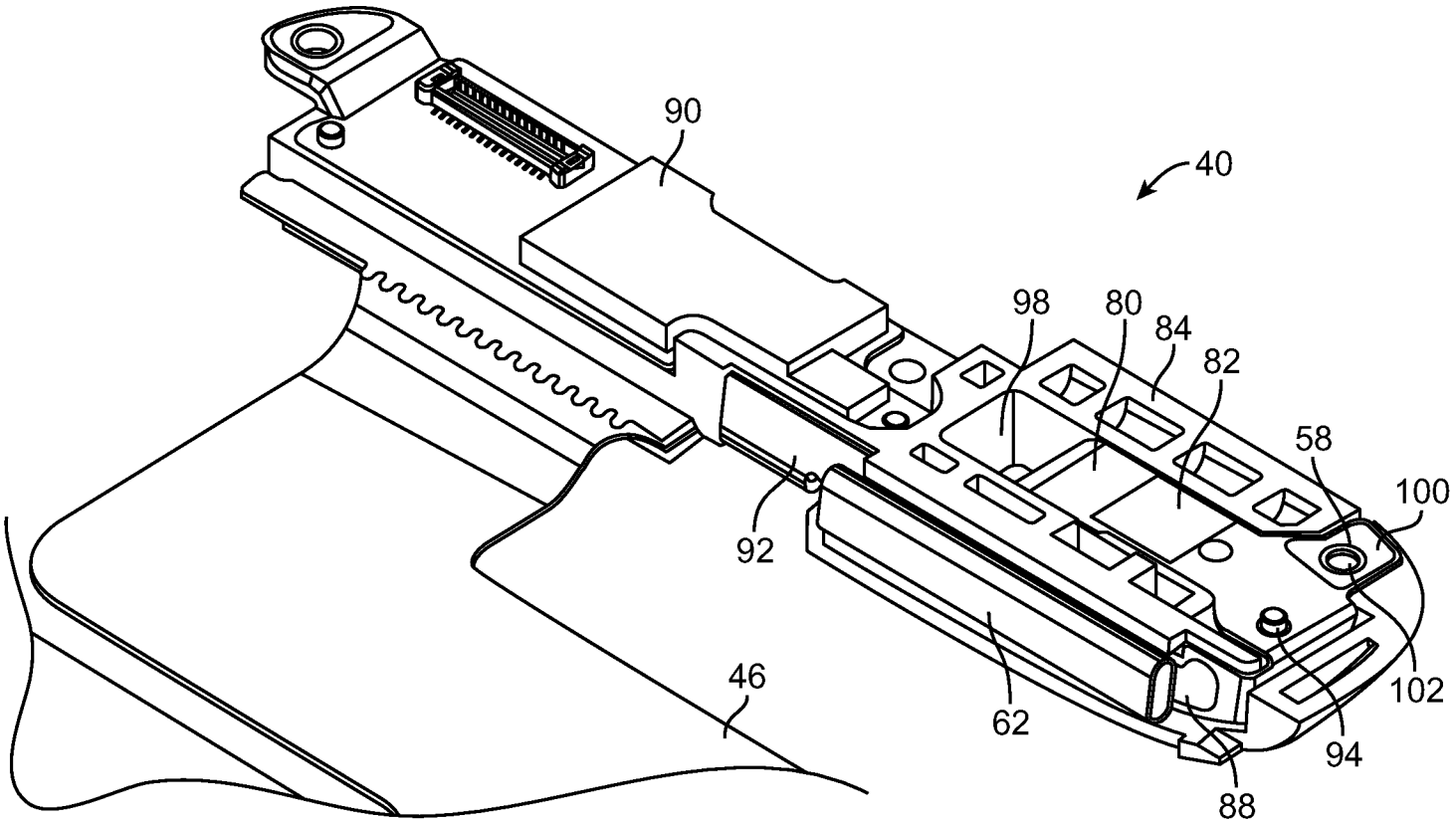
FIG. 10 is a front perspective view of an antenna assembly in accordance with an embodiment of the present invention.

As shown in FIG. 10, antenna assembly 40 may be formed by mounting antenna flex circuit 80 to antenna support 84. Antenna flex circuit 80 may contain conductive antenna traces for forming an inverted-F antenna, as described in connection with FIG. 5. Antenna support 84 may be, for example, a dielectric support formed from plastic. Integrated circuits such as integrated circuit 90 may be mounted on flex circuit 80. Integrated circuit 90 may be, for example, an integrated circuit for processing touch screen signals in device 10. Flex circuit 80 may include interconnects that interconnect integrated circuits such as circuit 90 with circuitry on main logic board 44 (FIG. 5). For example, meandering connector portion 46 of flex circuit 80 may contain digital and analog signals paths (buses) for conveying signals between antenna assembly 40 and main logic board 44.

In region 92, antenna flex circuit 80 may bend upward as shown in FIG. 10. This portion of antenna flex circuit 80 may contain a transmission line such as a microstrip transmission line, as described in connection with segment 48 of FIG. 5. Conductive elastic connector 62 (e.g., conductive foam such as foam that is wrapped on its surface with a conductive material or that is impregnated with conductive particles, etc.), may be mounted on exposed conductive ground trace 88 on flex circuit 80. After bending several additional times, flex circuit 80 may protrude downward into hole 98 of support 84 and may wrap around the underside of support 84. In this configuration, the tip of arm 36 in flex circuit 80 is not located immediately adjacent to conductive portions of case 12, which helps to ensure satisfactory antenna performance.

If desired, alignment features may be provided on antenna support 84 to help guide antenna flex circuit 80. For example, antenna flex circuit 80 may have alignment holes that mate with alignment posts such as alignment post 94 in FIG. 10. Shorting region 58, which may be associated with a screw that is electrically connected to case 12, may have ground conductive trace 100 surrounding screw hole 102. A screw such as screw 142 (FIG. 15) may be used to ground the antenna to housing 12 at point 58.

Dielectric loading structure 82 of FIG. 5 is an example of a dielectric structure that may be selectively added to antenna 18 during the manufacturing process to tune the antenna. As described in connection with FIGS. 6 and 7, when the amount of dielectric loading material that is mounted on antenna flex 80 in the vicinity of the antenna resonating element traces is adjusted, the frequency resonances of the antenna are shifted. Changes in dielectric loading structures such as loading structure 82 of FIG. 10 may therefore be used to tune the antenna. With one suitable arrangement, structure 82 may be mounted on flex circuit 80 using adhesive (e.g., adhesive on structure 82 or double-sided tape). Structure 82 may be, for example, a patch of polyimide. Additional loading structures (e.g., pieces of plastic, etc.) may also be mounted on flex circuit 80 if desired. The arrangement of FIG. 10 is merely illustrative.

Figure 11:
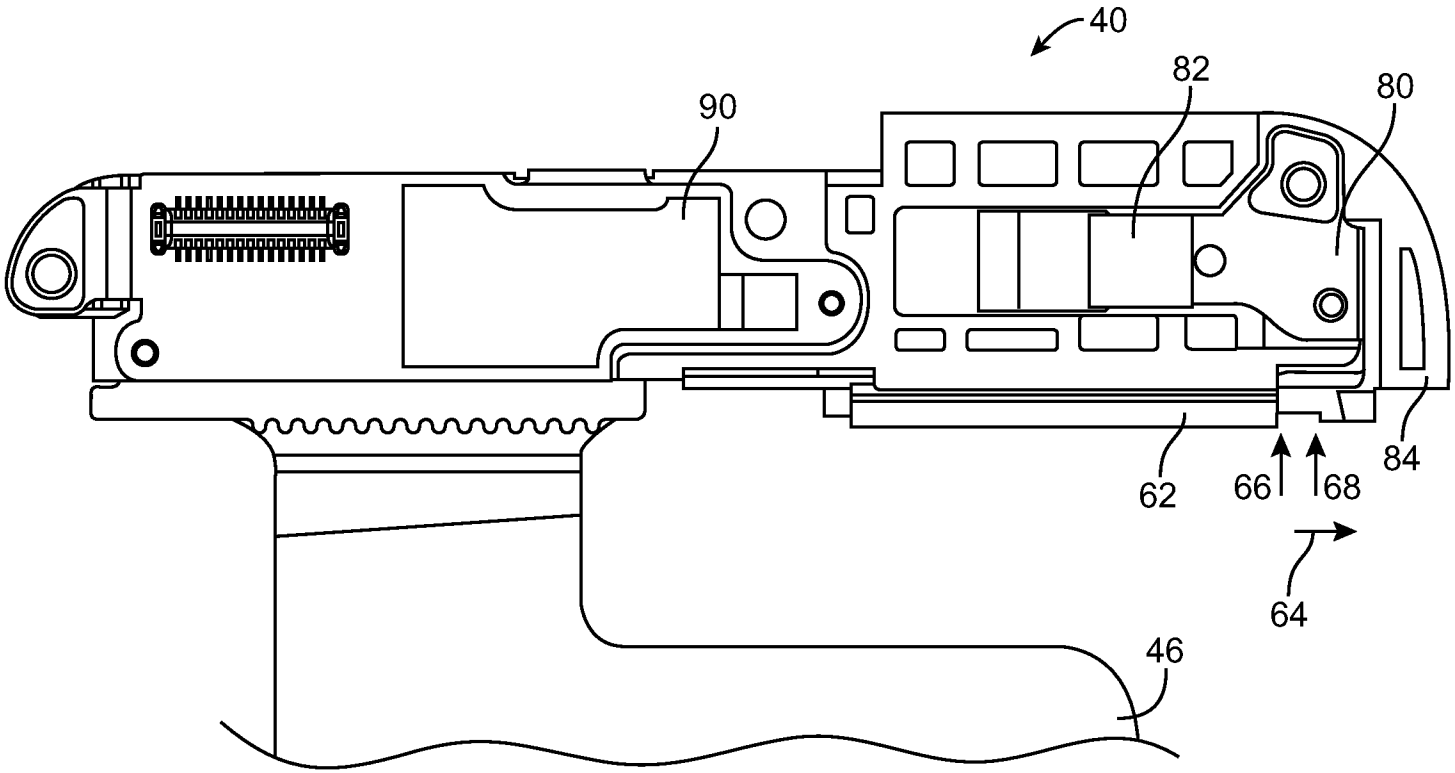
FIG. 11 is a top view of an antenna assembly in accordance with an embodiment of the present invention.

FIG. 11 shows a top view of the antenna assembly of FIG. 10. As described in connection with FIGS. 4 and 5, the position at which the end of conductive structure 62 is attached to the conductive ground trace on antenna flex circuit 80 (i.e., position 66 or position 68 along lateral dimension 64) affects the length of ground return path L1 (FIG. 4) and thereby tunes the antenna.

Figure 12:
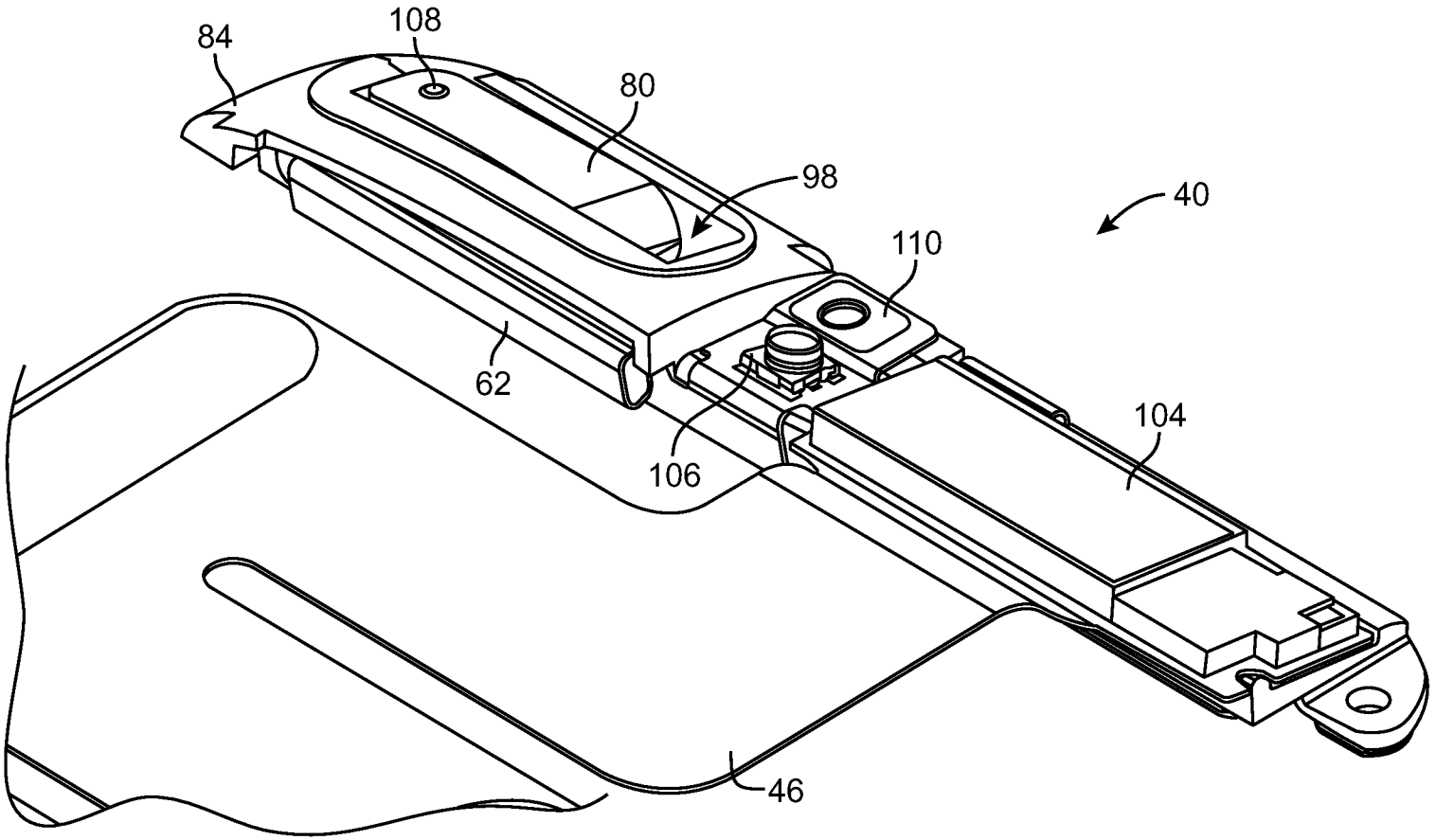
FIG. 12 is a rear perspective view of an antenna assembly in accordance with an embodiment of the present invention.

As shown in FIG. 12, a radio-frequency connector such as connector 106 may be interposed in the transmission line portion of the radio-frequency signal path in antenna flex 80. A test probe may be connected to connector 106 during calibration and testing operations. FIG. 12 also shows how an alignment feature such as alignment post 108 may be provided at the distal tip of antenna flex 80, after antenna flex 80 has passed through hole 98. Grounding structure 110 may receive a screw that helps to ground antenna assembly 40 to housing 12.

Integrated circuit 104 may be, for example, a radio-frequency transceiver module. As with integrated circuit 90 of FIG. 10, module 104 of FIG. 12 may be connected to flex circuit 80. In a typical arrangement, the surface of flex circuit 80 under circuits 90 and 104 is provided with pads to which the pins of circuits 90 and 104 may be attached with solder. Circuitry 90 and 104 may include integrated circuits, radio-frequency shielding structures (cans), discrete components (e.g., surface mount components), or any other suitable circuitry.

Figure 13:
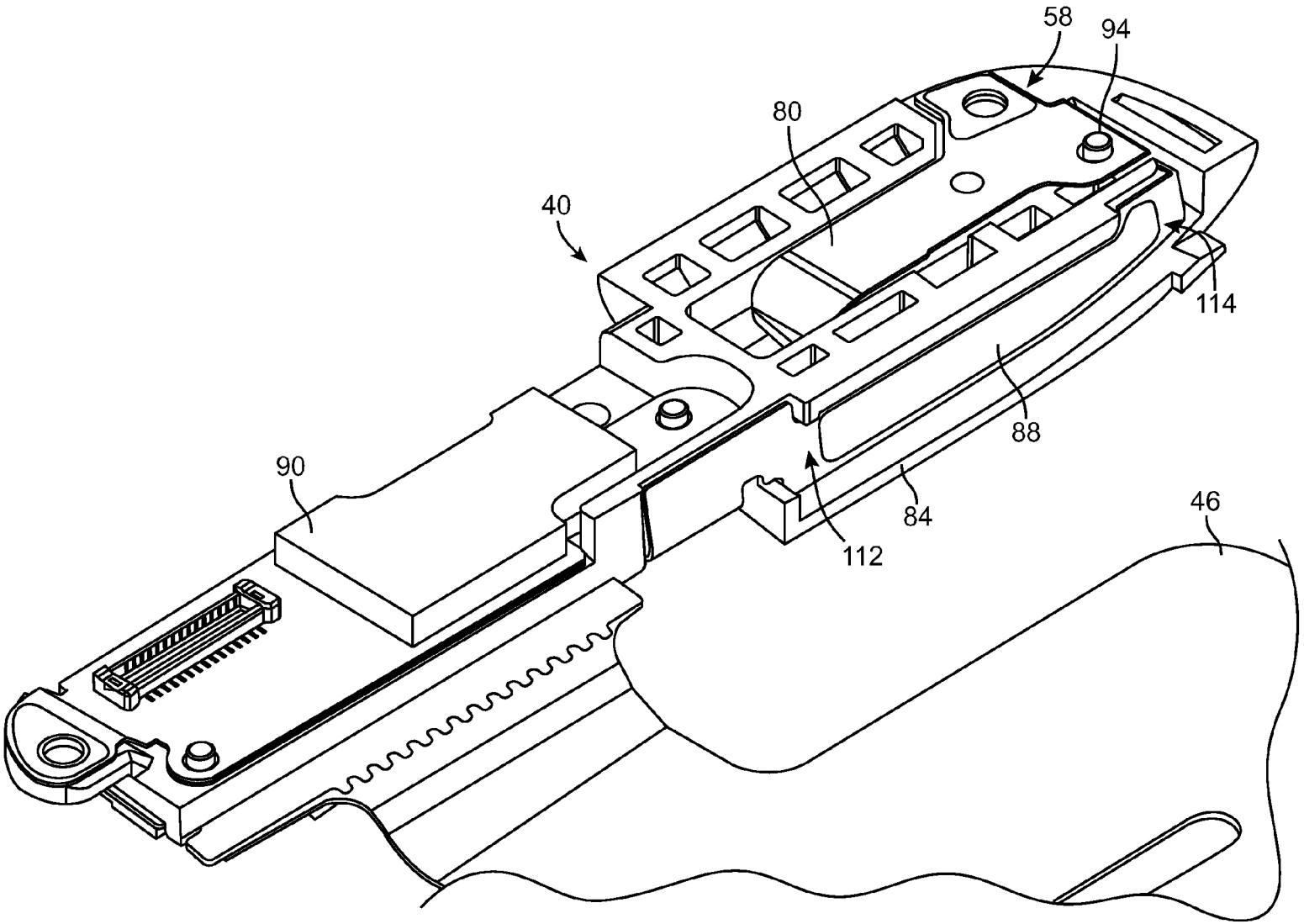
FIG. 13 is a front perspective view of an antenna assembly showing how a portion of an antenna flex circuit may be provided with a conductive trace that mates with an elastic connector in accordance with an embodiment of the present invention.

FIG. 13 shows ground trace 88 on antenna flex circuit 80 in a configuration where trace 88 is not visually obscured by conductive foam 62. As shown in FIG. 13, conductive trace 88 may extend from location 112 to location 114 along the surface of flex circuit 80. This provides an extensive grounding pad to which conductive foam 62 may be attached to complete the antenna's ground return path. The relatively large size of trace 88 may also provide sufficient margin to allow the lateral position of conductive foam 62 to be adjusted, without significantly overhanging the ends of trace 88.

Figure 14:
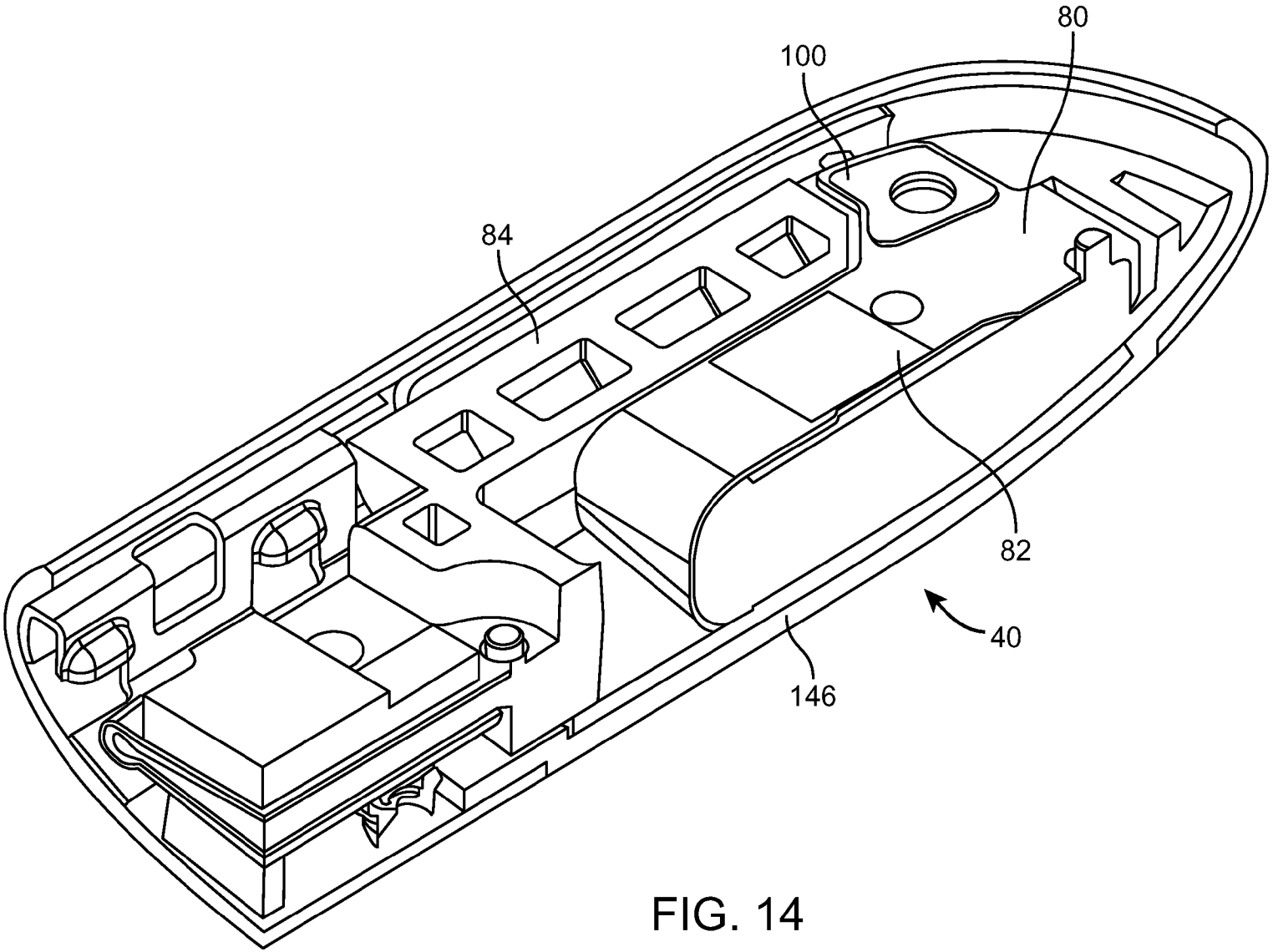
FIG. 14 is a cross-sectional perspective view of an antenna assembly in accordance with an embodiment of the present invention.
Figure 15:
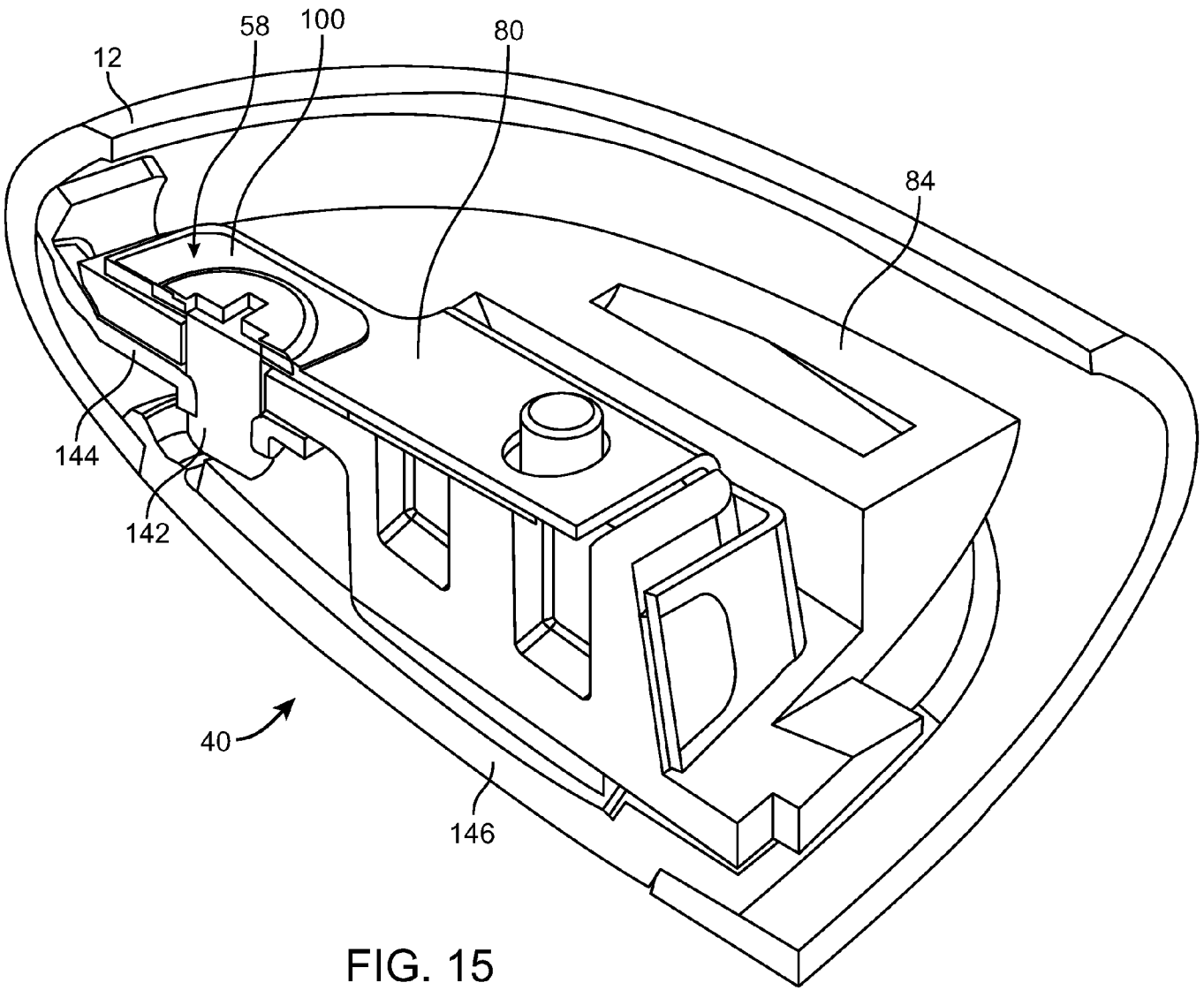
FIG. 15 is a cross-sectional perspective view of a portion of an antenna assembly showing how the antenna may be grounded to a conductive device housing in accordance with an embodiment of the present invention.

As shown in FIG. 14, the antenna formed by flex circuit 80 may be mounted over a dielectric window (window 20 of FIG. 2) that is formed from a plastic insert such as insert 146. FIG. 15 shows another cross-sectional view of plastic insert 146. FIG. 15 also shows how ground trace 100 on antenna flex 80 may be grounded to conductive housing 12 at ground point 58 using conductive metal screw 142 and conductive structure 144 (e.g., a metal prong).

Figure 16:
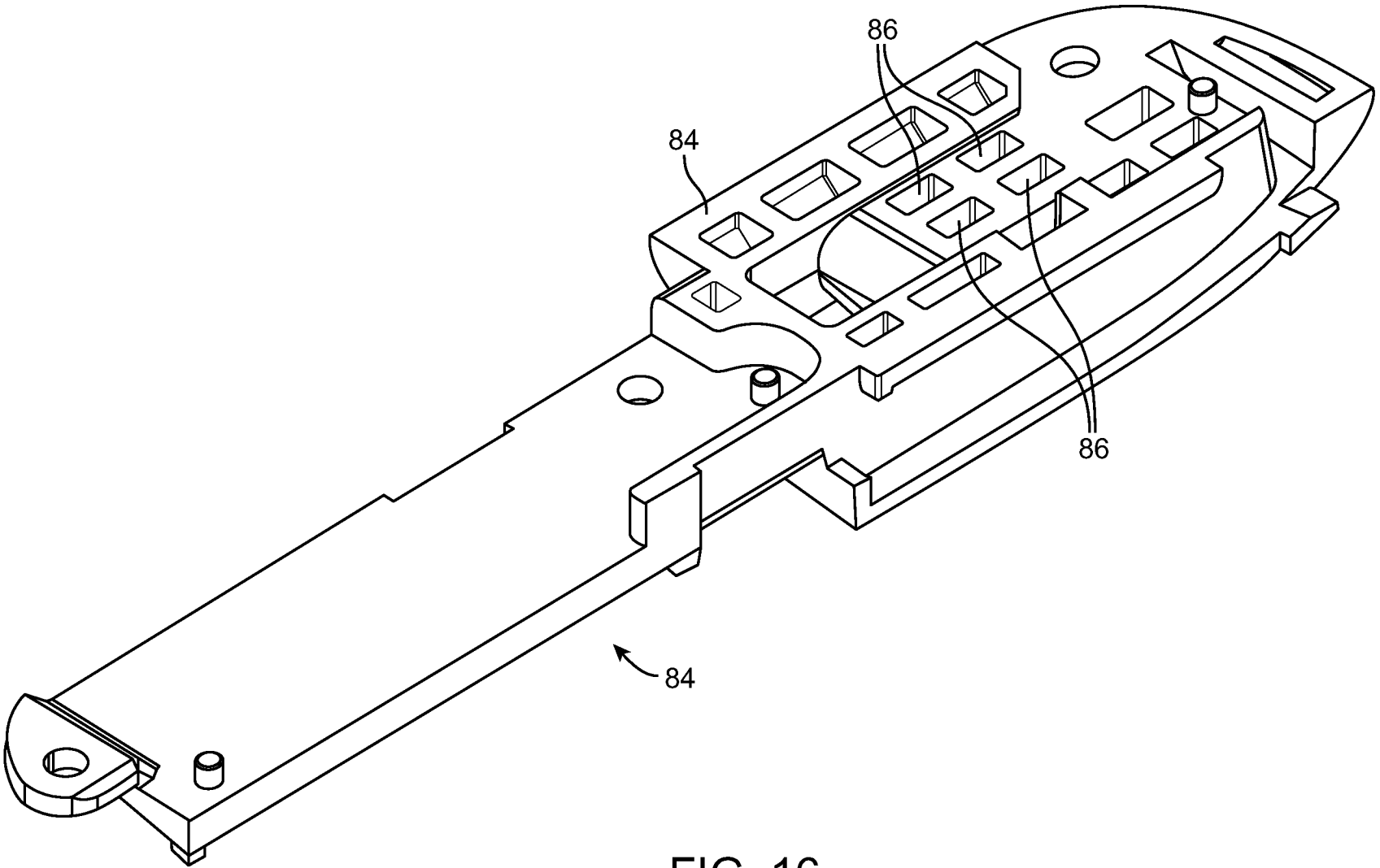
FIG. 16 is a perspective view of an antenna support that may be used in an antenna assembly in accordance with an embodiment of the present invention.

A perspective view of antenna support 84 without any attached structures is shown in FIG. 16. As shown in FIG. 16, antenna support 84 may have cavities 86 of the type described in connection with FIGS. 8 and 9. A selectable number of cavities 86 may be filled with a dielectric such as foam to add dielectric loading to antenna 18 and thereby tune the antenna's frequency response during the manufacturing process, if warranted by testing. In the example of FIG. 16, cavities 86 are shown as having the shape of prisms (i.e., polyhedrons with rectangular surface cross sections). This is merely illustrative. The volumes occupied by cavities 86 may have any suitable shapes such as conical shapes, hemispherical shapes, prisms and other polyhedrons, pyramids, cylinders, cones, combinations of these forms, etc. The use of polyhedral shapes is merely illustrative. Moreover, it is not necessary for cavities 86 to be deep (i.e., having depths that are comparable to or greater than their lateral dimensions). An advantage of such cavities is, however, that the weight of antenna support structure 84 can be reduced relative to antenna support structures 84 that use shallower cavity shapes (e.g., volumes in which the wall heights are less than the lengths and widths of the cavity at the surface).

Figure 17:
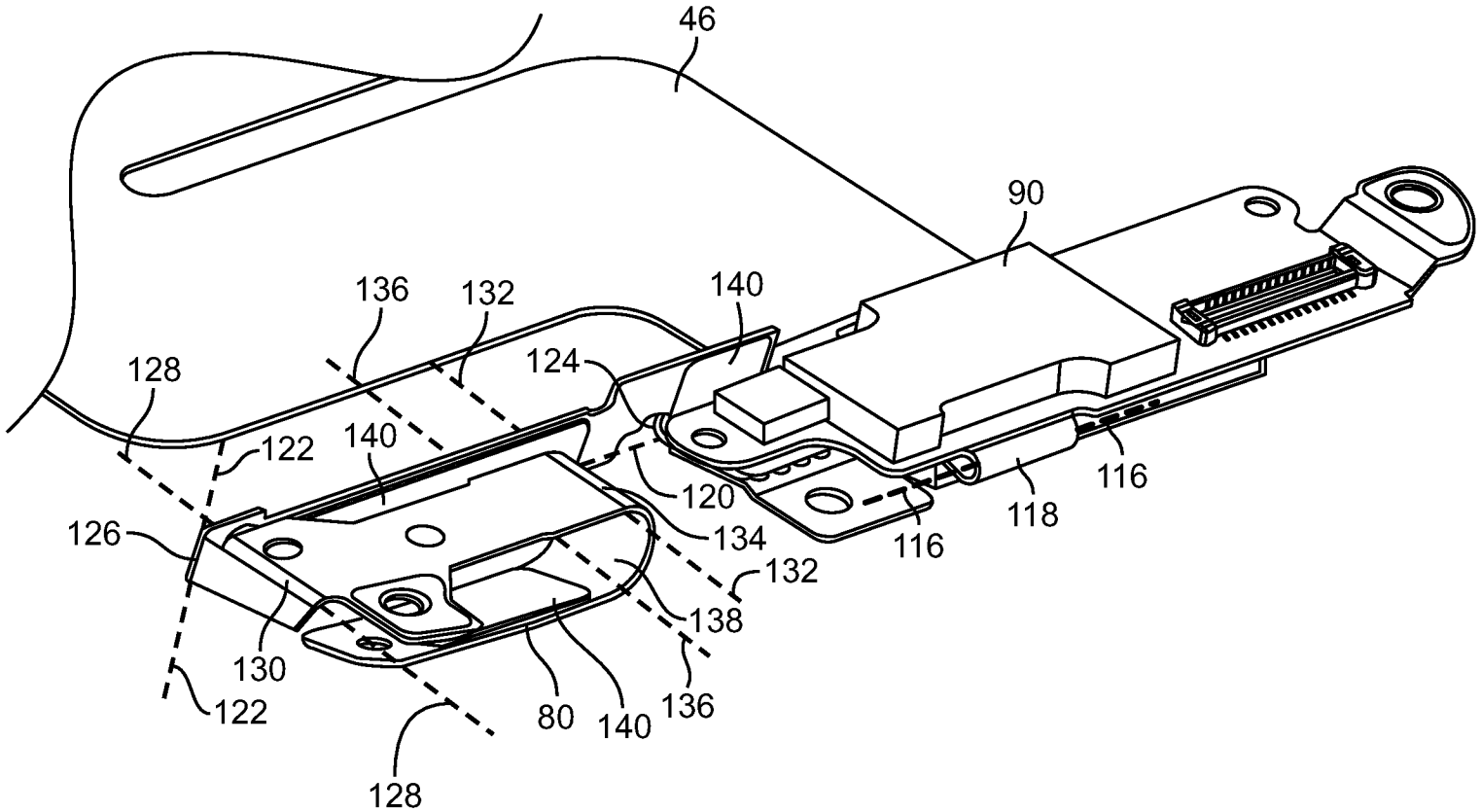
FIG. 17 is a perspective view of an antenna assembly in accordance with an embodiment of the present invention from which the antenna support of FIG. 16 has been omitted.

A perspective view of antenna flex 80 without antenna support structure 84 is shown in FIG. 17. As shown in FIG. 17, antenna flex circuit 80 forms a substantially three-dimensional, non-planar structure. Initially, flex 80 is coplanar with meandering flex circuit portion 46. At bend 118, flex circuit 80 bends 180° around axis 116 (effectively making two adjacent 90° bends). At bend 124, flex circuit 80 makes a right-angle band upward around horizontal axis 120. At bend 126, flex circuit 80 makes a right-angle band around vertical axis 122. Another right-angle bend (bend 130) is formed around horizontal axis 128. Two additional bends (bends 134 and 138) are formed by bending flex circuit 80 around axis 132 and axis 136.

Any suitable techniques may be used to mount antenna flex circuit 80 to antenna support structure 84. For example, adhesive or double-sided adhesive film 140 (i.e., tape) may be used to attach flex circuit 80 to support 84 and to make other attachments in device 10.

Figure 18:
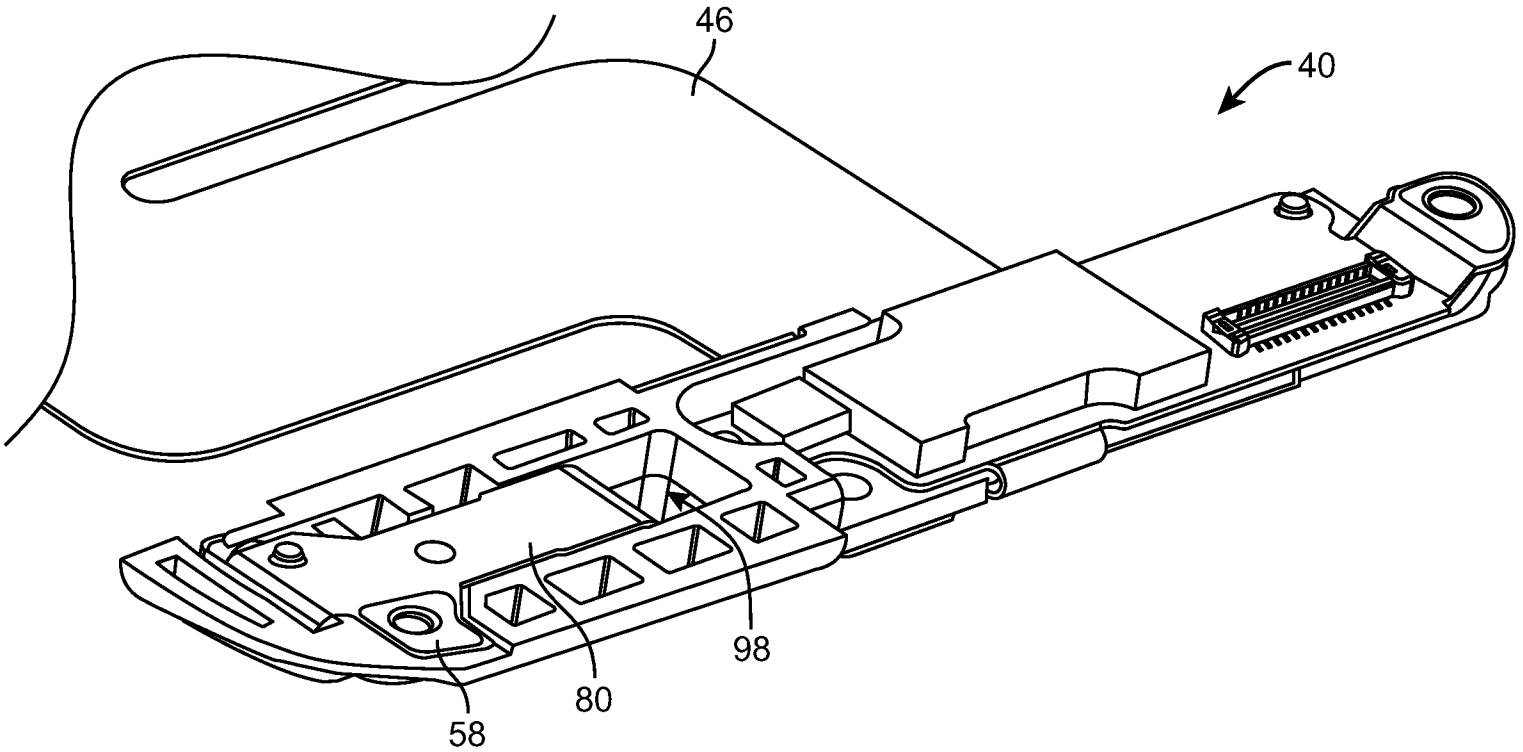
FIG. 18 is a perspective view of an antenna assembly that includes an antenna support of the type shown in FIG. 16 and an antenna flex circuit of the type shown in FIG. 17 in accordance with an embodiment of the present invention.
Figure 19:
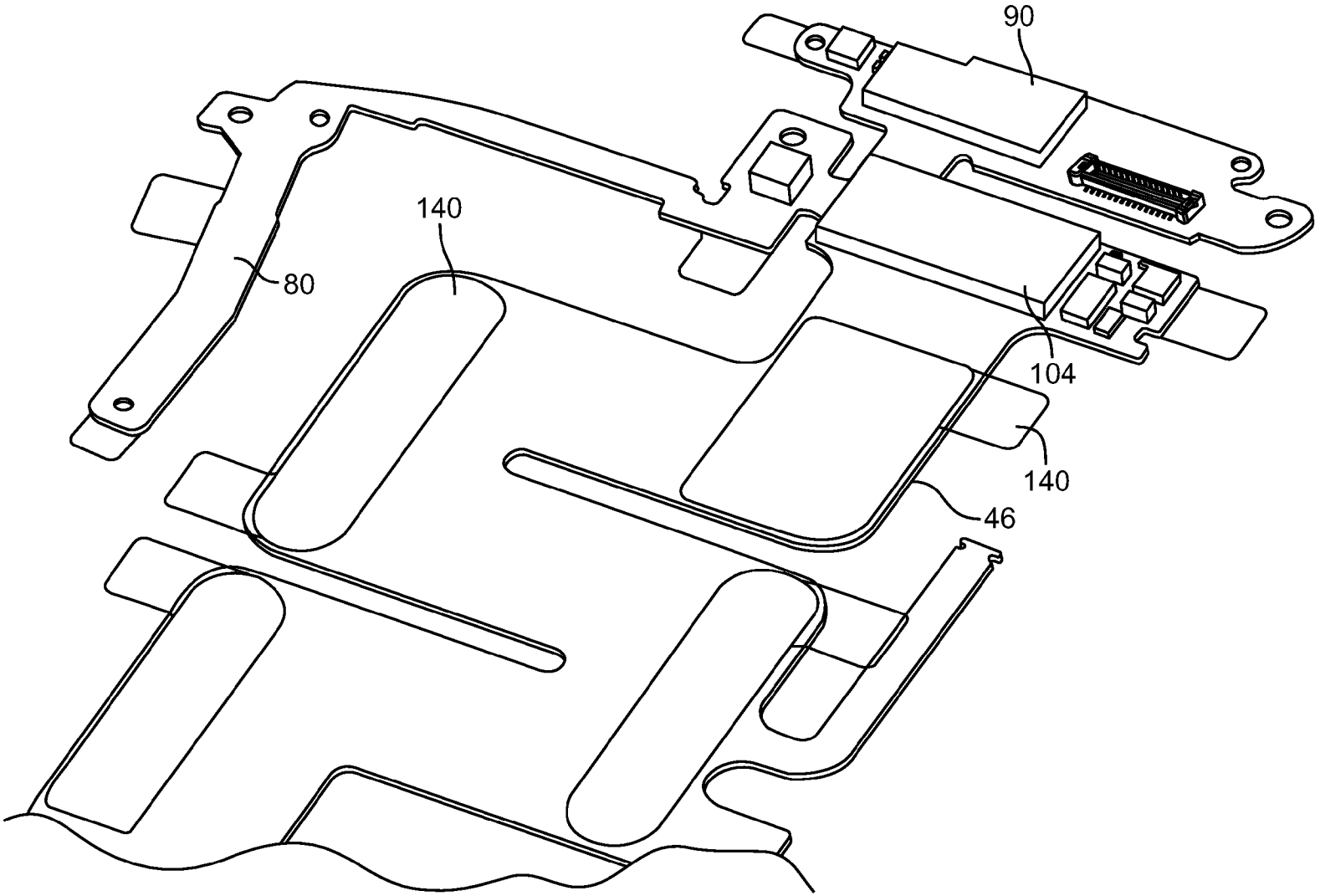
FIG. 19 is a perspective view of an antenna flex circuit that is formed as an integral portion of a larger flex circuit structure and which is shown in its unassembled state unattached to an antenna support in accordance with an embodiment of the present invention.

FIG. 18 shows antenna flex circuit 80 as it is typically attached to antenna support structure 84. Before assembly, antenna flex circuit 80 is unbent, as shown in the unassembled view of FIG. 19.

Figure 20:
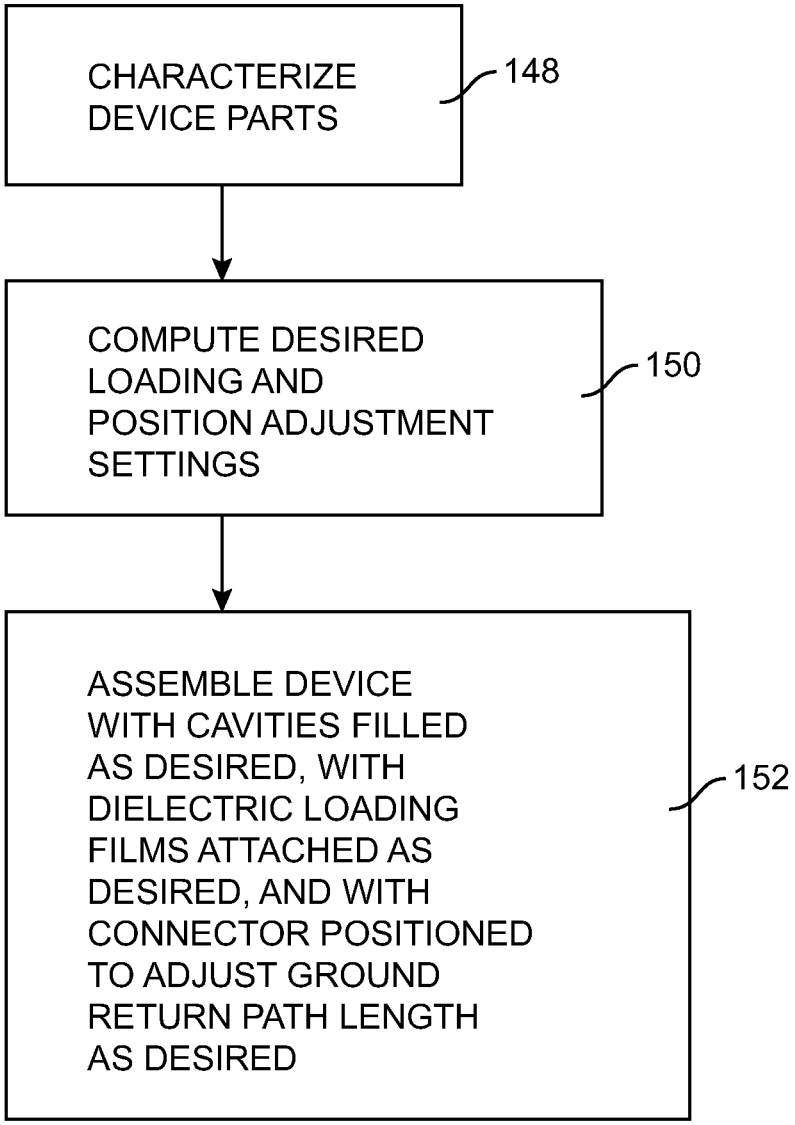
FIG. 20 is a flow chart of illustrative steps involved in testing electronic device antennas and making corresponding antenna tuning adjustments during manufacturing in accordance with an embodiment of the present invention.

A flow chart of illustrative steps involved in characterizing and adjusting antennas and handheld electronic devices in accordance with embodiments of the present invention is shown in FIG. 20.

At step 148, during the manufacturing process or as part of a pre-qualification process, some or all of the parts that are to be used to form device 10 may be characterized. Characterization measurements may be performed by measuring components individually (e.g., to gather data on mechanical and electrical component properties) or may be performed by performing tests on complete test devices or complete subassemblies. As an example, an antenna may be fabricated and its performance may be measured. Test equipment can be used, for example to make voltage standing wave ratio (VSWR) measurements to plot the frequency peaks for the antenna.

After characterizing the parts that will be assembled to form device 10 during manufacturing, adjustments to be made may be computed at step 150. Available adjustments may include position adjustments to the conductive elastic connection 62 (e.g., the conductive foam lateral position along antenna ground trace 88), dielectric loading adjustments (e.g., using dielectric layers such as layer 82 of FIG. 10), and dielectric cavity filling adjustments (e.g., to fill cavities 86 of FIG. 16). Computations may be performed using analytical techniques, numeric techniques (e.g., computer-implemented computational techniques), and/or by using empirical methods (e.g., trial and error followed by recharacterizing measurements by repeating step 148).

After it has been determined which of the antenna tuning adjustments are to be made, the manufacturer may issue instructions to the robotic assembly equipment and/or assembly personnel at the manufacturing facility to assemble device 10 according to the desired adjustment settings. At step 152, devices 10 may be assembled that include appropriate amounts of dielectric film loading, dielectric cavity filling, and ground return path length adjustments to ensure that the antennas in devices 10 perform optimally and in accordance with the desired parameters computed at step 150. The process of FIG. 20 may therefore ensure that devices 10 are produced with appropriately tuned antenna performance.

As these examples demonstrate, the flex circuit architecture that is used for antenna 18 in device 10 allows the performance of antenna 18 to be adjusted using several different performance-adjusting features. Moreover, the use of a single flex circuit such as flex circuit 80 for mounting multiple integrated circuits, for forming the entire antenna, and for forming signal paths to remote portions of device 10 helps to reduce assembly cost and complexity. Reliability may also be improved, because connectors for interconnecting the antenna with other portions of device 10 may be eliminated. The three-dimensional shape that is formed for antenna 18 by bending flex circuit 80 repeatedly around antenna support structure 84 has been demonstrated to exhibit satisfactory antenna efficiency and allows the antenna to be formed in the compact confines of a handheld electronic device such as a device with a conductive housing.

Antenna path length adjustments may be made by tuning the lengths of any suitable conductive paths associated with antenna 18. The use of tuning arrangements based on conductive members such as conductive foam members that are placed at an adjustable position within the ground return path is merely illustrative. Moreover, as described in connection with FIG. 5, any suitable adjustable conductive element may be used in forming an adjustable path length in the antenna.

Figure 21:
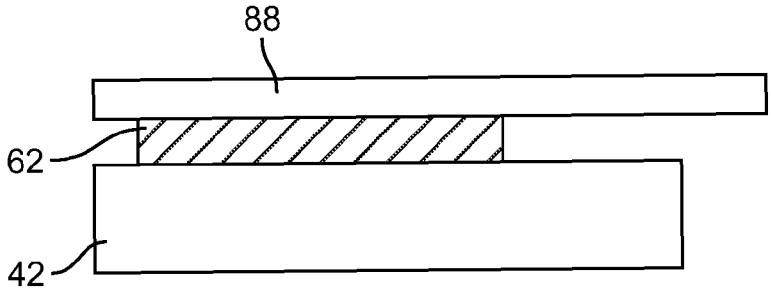
FIG. 21 is a cross-sectional side view showing how an inverted-F antenna in an electronic device may be tuned by adjusting the position of a conductive elastomeric member such as a piece of conductive foam in accordance with an embodiment of the present invention.

FIG. 21 is a cross-sectional side view showing how an inverted-F antenna such as antenna 18 may be tuned by making lateral position adjustments to conductive foam member 62, ad described in connection with FIGS. 5 and 10. As shown in FIG. 21, conductive foam member 62 may form a conductive elastomeric structure that is compressed between conductive antenna ground trace 88 on flex circuit 80 and a conductive portion of device 10 such as a conductive midplate or other internal metal support structure 42. As shown in FIG. 5, structure 42 may, in turn, be shorted to other conductive structures such as conductive housing 12, thereby forming the rest of the ground return path for the inverted-F antenna by electrically shorting ground point 58 (FIG. 5) to ground trace 88.

An advantage of conductive elastomeric members and other members that can flex during assembly is that these members are compressible and can therefore accommodate variations in the sizes of the parts of device 10 that arise as part of a normal manufacturing process. It is not necessary, however, to use conductive foam to form the adjustable connector for the antenna.

Figure 22:
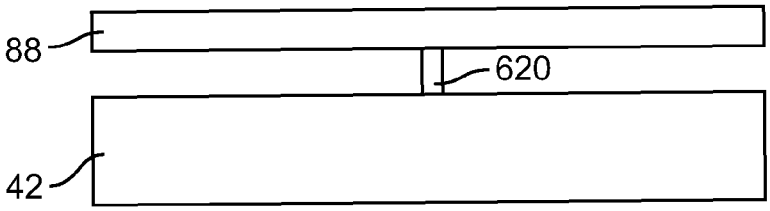
FIG. 22 is a cross-sectional side view showing how an inverted-F antenna in an electronic device may be tuned by adjusting the position of a conductive member such as a metal spring member in accordance with an embodiment of the present invention.

As shown in FIG. 22, for example, a spring such as spring 620 may be placed at a suitable lateral position along the length of trace 88. Spring 620 may be a metal spring that is formed as part of a tang on midplate 42. During assembly, the manufacturer can bend spring 620 into place and can bend away or break off similar springs that are unused. Alternatively, a separate spring such as spring 620 can be attached at an appropriate location on trace 88 or midplate 42 using welds, conductive adhesive, or other suitable fasteners.

Figure 23:
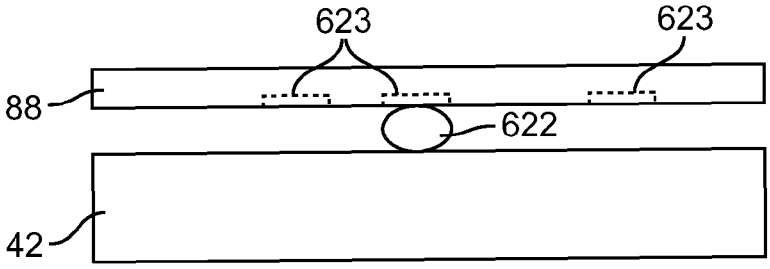
FIG. 23 is a cross-sectional side view showing how an inverted-F antenna in an electronic device may be tuned by adjusting the position of a conductive connector such as a solder connection in accordance with an embodiment of the present invention.

In the example of FIG. 23, a cross-sectional view is presented that shows how an inverted-F antenna in a handheld device may be tuned by adjusting the position of a conductive connector such as a solder connection. Solder bump 622 may be formed on trace 88 (e.g., on a predefined pad such as one of pads 623 that branch off from the rest of trace 88), may be formed on midplate 42, or may otherwise be interposed in the ground return path.

Figure 24:
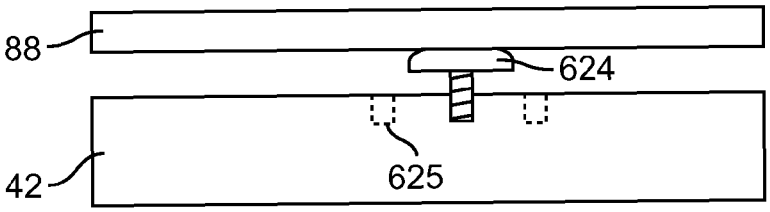
FIG. 24 is a cross-sectional side view showing how an inverted-F antenna in an electronic device may be tuned by adjusting the position of a conductive connector such as a screw or other mechanical fastener in accordance with an embodiment of the present invention.

FIG. 24 is a cross-sectional view showing how an inverted-F antenna such as antenna 18 may be tuned by adjusting the position of a conductive connector such as a screw or other mechanical fastener (fastener 624). To allow the lateral position of fastener 624 to be adjusted, midplate 42 may be provided with a series of threaded holes 625 into which the fastener may be inserted during assembly. Fastener 624 may be any suitable fastener such as a nut, rivet, bolt, etc.

Figure 25:
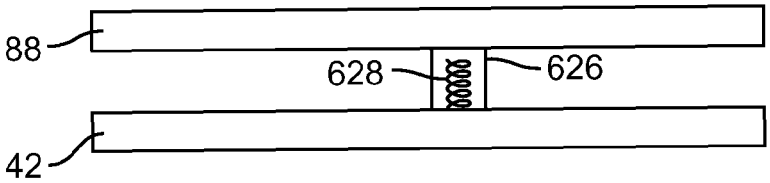
FIG. 25 is a cross-sectional side view showing how an inverted-F antenna in an electronic device may be tuned by adjusting the position of a conductive connector such as a spring-loaded pin in accordance with an embodiment of the present invention.

Another illustrative arrangement is shown in FIG. 25. In the example of FIG. 25, the adjustable connection for antenna 18 is formed using spring-loaded pin 626. As shown in the cross-section of FIG. 25, spring loaded pin 626 (which may be, for example, a Pogo® pin) may contain an internal biasing member such as spring 628. Pins such as pin 626 are compressible. As with other elastic connector arrangements, pins 626 may therefore help accommodate variations in the sizes of the structures in device 10 that arise during manufacturing. With one suitable arrangement, a pin such as pin 626 may be welded to midplate 42 at a desired location along midplate. When device 10 is assembled, the welded location will cause the exposed end of pin 626 to bear against ground trace 88 at a location along its length that tunes antenna 18 as desired.

Although shown separately in the examples of FIGS. 21, 22, 23, 24, and 25, the structures of these examples may be used in any suitable combination. Antenna 18 may include none, one, two, three, or more than three structures in its conductive paths. Moreover, dielectric loading schemes using additional layers of dielectric and selectively filled antenna support cavities may be used to provide additional or alternative tuning options if desired.

The foregoing is merely illustrative of the principles of this invention and various modifications can be made by those skilled in the art without departing from the scope and spirit of the invention.

What is claimed is:

1. A method of tuning an inverted-F antenna in a handheld electronic device, wherein the inverted-F antenna is formed from an antenna flex circuit mounted to a dielectric antenna support structure and has a ground return path of a given length, the method comprising:

making measurements to characterize the inverted-F antenna;

based on the measurements, determining how to adjust the inverted-F antenna to tune the inverted-F antenna to a desired frequency of operation; and after determining how to adjust the antenna, tuning the inverted-F antenna during assembly of the handheld electronic device by making an adjustment selected from the group consisting of: an adjustment to the given length of the ground return path, an adjustment to dielectric loading for the antenna provided by dielectric film on the antenna flex circuit, and an adjustment to dielectric loading for the antenna provided by filling selected cavities in the dielectric antenna support with dielectric.

2. The method defined in claim 1 wherein the dielectric antenna support structure comprises a plurality of cavities that are covered by the antenna flex circuit when the antenna flex circuit is mounted to the dielectric antenna support structure and wherein tuning the inverted-F antenna comprises filling at least one of the plurality of cavities with dielectric foam while leaving at least one other of the plurality of cavities filled with air to adjust dielectric loading on the antenna flex circuit.

3. The method defined in claim 2 wherein the ground return path includes a piece of conductive foam and wherein tuning the inverted-F antenna comprises selectively attaching the conductive foam to a ground trace on the flex circuit at a location that tunes the antenna as determined from the measurements.

4. The method defined in claim 3 wherein the dielectric film comprises a patch of polyimide and wherein tuning the inverted-F antenna comprises selectively attaching the polyimide patch to the antenna flex circuit during manufacturing when needed to tune the antenna.

5. The method defined in claim 1 wherein tuning the inverted-F antenna during assembly of the handheld electronic device by making the adjustment comprises making the adjustment to the given length of the ground return path.

6. The method defined in claim 5 wherein the ground return path includes a piece of conductive foam and wherein making the adjustment to the given length of the ground return path comprises selectively attaching the conductive foam to a ground trace on the flex circuit at a location that tunes the antenna as determined from the measurements.

7. The method defined in claim 1 wherein tuning the inverted-F antenna during assembly of the handheld electronic device by making the adjustment comprises making the adjustment to the dielectric loading for the antenna provided by the dielectric film on the antenna flex circuit.

8. The method defined in claim 7 wherein the dielectric film comprises a patch of polyimide and wherein making the adjustment to the dielectric loading for the antenna provided by the dielectric film on the antenna flex circuit comprises selectively attaching the polyimide patch to the antenna flex circuit during manufacturing when needed to tune the antenna.

9. The method defined in claim 1 wherein tuning the inverted-F antenna during assembly of the handheld electronic device by making the adjustment comprises making the adjustment to the dielectric loading for the antenna provided by the filling of the selected cavities in the dielectric antenna support with the dielectric.

10. The method defined in claim 9 wherein the dielectric antenna support structure comprises a plurality of cavities that are covered by the antenna flex circuit when the antenna flex circuit is mounted to the dielectric antenna support structure and wherein making the adjustment to the dielectric loading for the antenna provided by the filling of the selected cavities in the dielectric antenna support with the dielectric comprises filling at least one of the plurality of cavities with dielectric foam while leaving at least one other of the plurality of cavities filled with air to adjust dielectric loading on the antenna flex circuit.

11. A method of tuning an antenna in an electronic device, wherein the antenna is formed from an antenna circuit mounted to a dielectric antenna support structure and has a ground return path of a given length, the method comprising:

making measurements to characterize the antenna;

based on the measurements, determining how to adjust the antenna to tune the antenna to a desired frequency of operation; and after determining how to adjust the antenna, tuning the antenna during assembly of the electronic device wherein tuning the antenna during assembly of the electronic device comprises at least one step selected from the group consisting of: adjusting the given length of the ground return path, adjusting dielectric loading for the antenna by applying at least one dielectric film to the antenna circuit, and adjusting dielectric loading for the antenna by filling at least one cavity in the dielectric antenna support structure with dielectric.

12. The method defined in claim 11 wherein filling at least one cavity in the dielectric antenna support structure with dielectric comprises filling selected cavities in the dielectric antenna support with dielectric.

13. The method defined in claim 11 wherein turning the antenna during assembly of the electronic device comprises adjusting the given length of the ground return path.

14. The method defined in claim 13 wherein adjusting the given length of the ground return path comprises adjusting the position along the ground return path of a conductive component.

15. The method defined in claim 11 wherein turning the antenna during assembly of the electronic device comprises applying at least one dielectric film to the antenna circuit.

16. The method defined in claim 11 wherein turning the antenna during assembly of the electronic device comprises filling at least one cavity in the dielectric antenna support structure with dielectric.

17. A method of tuning an antenna in an electronic device, wherein the antenna has a ground return path of a given length, the method comprising:

making measurements to characterize the antenna;

based on the measurements, determining how to adjust the antenna to tune the antenna to a desired frequency of operation; and after determining how to adjust the antenna, tuning the antenna during assembly of the electronic device by adjusting the given length of the ground return path.

18. The method defined in claim 17 wherein the ground return path includes a piece of conductive foam and wherein tuning the antenna comprises selectively attaching the conductive foam to the antenna at a location that tunes the antenna as determined from the measurements.

19. The method defined in claim 17 wherein making the measurements to characterize the antenna comprises making voltage standing wave ratio (VSWR) measurements.

* * * * *